US005423150A

United States Patent [19]

Hitchcock

[11] Patent Number: 5,423,150

[45] Date of Patent: Jun. 13, 1995

[54] AUTOMATED EXTERIOR FIRE PROTECTION SYSTEM FOR BUILDING STRUCTURES

[76] Inventor: David J. Hitchcock, 3147 Killingworth La., Twinsburg, Ohio 44087

[21] Appl. No.: 149,674

[22] Filed: Nov. 9, 1993

[51] Int. Cl.[6] ..... A62C 3/02

[52] U.S. Cl. ..... 52/1; 52/3; 52/DIG. 12; 169/45; 169/48; 169/56; 169/60; 169/61; 169/67

[58] Field of Search ..... 52/3, DIG. 12, 1; 169/45, 56, 58, 60, 61, 67, 48

[56] References Cited

U.S. PATENT DOCUMENTS 3,576,212 4/1971 Siler ..... 169/48
3,766,958 10/1973 Mitchell ..... 169/48 X
4,791,994 12/1988 Ho ..... 169/45 X
5,165,482 11/1992 Smagac et al. ..... 169/45
5,263,543 11/1993 Nigro ..... 169/56

FOREIGN PATENT DOCUMENTS 2650274 5/1978 Germany ..... 169/48

*Primary Examiner*—Carl D. Friedman
*Assistant Examiner*—Christopher Todd Kent
*Attorney, Agent, or Firm*—Fay, Sharpe, Beall, Fagan, Minnich & McKee

[57] ABSTRACT

An automated exterior fire protection system deploys a fire resistant blanket that is preferably stored under the roof of the structure. Threatening fires are detected by a sensor to provide a signal that initiates automatic deployment of the blanket. Air bleed portions may be provided in the blanket to allow air trapped between the blanket and the structure to quickly dissipate. Moreover, elastic straps may be provided in the blanket to secure the blanket in place.

20 Claims, 4 Drawing Sheets

AUTOMATED EXTERIOR FIRE PROTECTION SYSTEM FOR BUILDING STRUCTURES

BACKGROUND OF THE INVENTION

This invention relates to an automated exterior fire protection system for a building structure and more particularly to an automated system that deploys a fire resistant blanket over a building structure to prevent it from burning as a result of an adjacent fire.

Fire protection systems for building structures are known in the prior art. U.S. Pat. No. 3,715,843 to Ballinger and U.S. Pat. No. 4,858,395 to McQuirk are two fire protection systems intended to protect a building structure such as a home against an approaching or oncoming fire.

The Ballinger '843 patent teaches a fire protection system comprised of distinct panel portions that are assembled on-site and placed over a building structure when the homeowner is apprised of an approaching fire. Reinforcing straps, tie downs, and specialized edge junctions are used to secure the panels together into an assembly that protects a home against airborne burning embers or a rapidly spreading fire such as a fire storm. Thus, even though the intent is to provide a simplified, easy to assemble protective structure, it still requires a large amount of manual labor to assemble. In fact, the Ballinger patent expressly states that his system uses a crew of men to deliver and construct the panel assembly on-site to homes in the path of a fire storm. Thus, the fire protection system of Ballinger requires a large amount of manual labor to assemble and secure the system in place. The '843 patent recognizes some particular problems encountered by a homeowner in trying to protect his property from a rapidly approaching fire, such as inadequate water pressure or high winds that can result in catastrophic consequences when local fire officials are unable to cope with the size, speed, and extent of a fire storm. The overall system, however, is believed capable of still further improvement.

The fire protection system described in the McQuirk '395 patent is mounted to the exterior of a building, particularly the peak of the roof. Although seemingly easier to position in place over the building structure, the McQuirk '395 patent arrangement has its own drawbacks. For example, by its design it is only able to accommodate simple building structure designs. It is believed that the structural shape of many of today's modern homes that have various split levels and segmented frame designs would prove difficult to cover with the fire protection system suggested by McQuirk.

Moreover, the McQuirk arrangement does not disclose how various portions of the building structure that stick out or protrude from the roof would be accommodated in the pull down, window shade type of fire protection system. Therefore, even though McQuirk '395 is a pre-installed system that does not require a large number of people to assemble the fire protection system in the face of an approaching fire, it is still necessary for the homeowner to manually deploy the system and requires the house to be attended so that the fire protection system could be used to advantage.

Even though the fire protection systems shown in these two prior art patents may be acceptable for certain types of dwellings, or for certain environmental conditions, there are still other needs and features that can result in an improved fire protection system. For example, a basic concern in protecting a building structure from an approaching fire is the ability to quickly and effectively deploy a fire resistant material or blanket around the entire structure before a fire starts. Often there is little warning of an approaching fire, particularly if the threatening fire spreads at night or while an occupant is away from his home. Even if a homeowner is present, the rapid movement of fire storms driven by high winds can still result in extensive property damage before conventional precautionary measures can be taken. Without the ability to quickly, completely, and automatically deploy a fire protection system, the building structure may quickly succumb to the approaching fire.

It is also deemed desirable to develop a fire protection system that does not expose a person or persons to the dangers of an approaching fire. Thus, the ability to automatically detect an approaching fire and automatically deploy the fire protecting system without human intervention are deemed to be primary goals inadequately addressed by the prior art.

Prior art designs do not adequately allow for ingress and egress to the building once the fire protection system is in place. The flame resistant material used in known systems is typically tough and difficult to cut through. Furthermore, this material is fairly heavy. Therefore, access into or out of the fire protection system may be desirable while still providing adequate protection and coverage of the building structure.

SUMMARY OF THE INVENTION

The present invention contemplates a new and improved fire protection system that overcomes all of the above-referenced problems and others, and provides for an automatic deployment of the system.

According to a more limited aspect of the invention, the fire protection system is adapted for mounting in an unused attic portion of a house, or in still another area of the home that does not adversely effect the visual aesthetics of the home.

According to another aspect of the invention, the fire protection system provides for an automatic deployment through the use of projectiles that deploy a fire resistant blanket upwardly and over the entire building structure in response to a signal.

According to yet another aspect of the invention, the fire protection system includes a detector arrangement that may sense an oncoming fire by an infrared sensor, a smoke detector, or similar detection system.

In still another arrangement, an audible alarm notifies an occupant or adjacent homeowners of the potential deployment of the fire protection system.

According to yet another aspect of the invention, access means may be provided for ingress and egress from the building structure after the fire protection system has been deployed.

Still another aspect of the invention includes an air bleed arrangement that permits air trapped between the fire resistant blanket and the building structure to pass through the blanket.

A principal advantage of the invention resides in the automatic deployment of the fire protection system.

Yet another advantage of the invention is found in its ability to cover a wide variety of building structures.

Still another advantage of the invention is realized by the hidden storage of the fire protection system when not in use.

Yet another advantage of the invention is the ability to allow air to escape from between the system and the building structure, while still providing for ingress and egress by an occupant after deployment of the system.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figure 1:
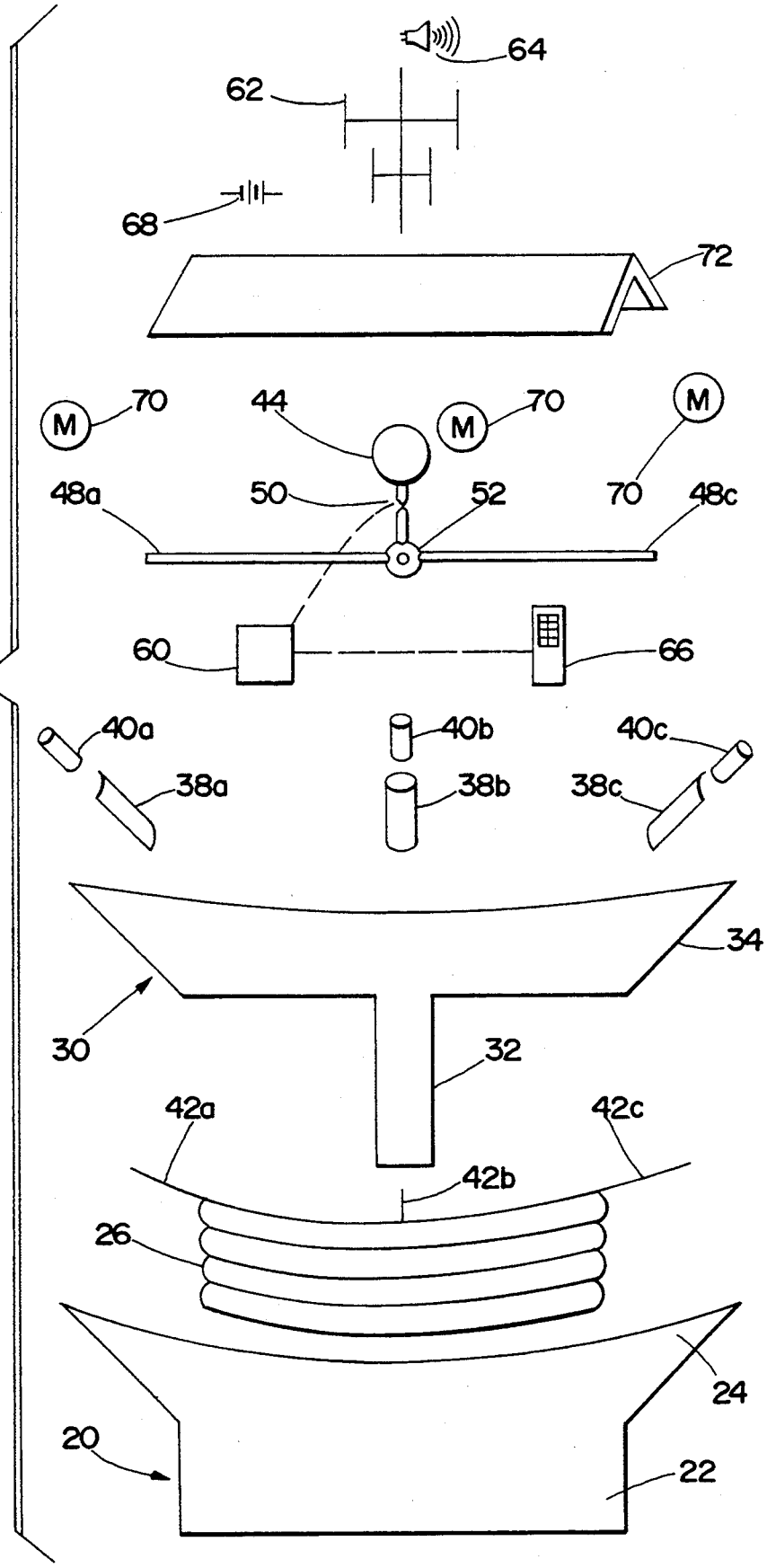
FIG. 1 is an exploded view of a first embodiment of the subject invention particularly illustrating various components of the fire protection system.

Referring now to the drawings wherein the showings are for purposes of illustrating a preferred embodiment of the invention only and not for purposes of limiting same, the FIGURES show a fire protection system A for use in covering a building structure B. More particularly, and with reference to FIGS. 1–3, the fire protection system A includes a base 20 that is typically mounted in an attic or other hidden region of the home or building structure. The base can adopt any number of configurations but is shown with a generally cylindrical, hollow lower portion 22 that opens upwardly into a generally conical portion 24. Received within the base is a fire resistant blanket 26. Typically, the blanket is folded for compact receipt in the lower portion of the base and in a manner that will aid in deployment as will be described further below. The blanket may have any of a number of configurations but is preferably a unitary structure that will completely envelop or cover the building structure B when fully deployed.

Figure 2:
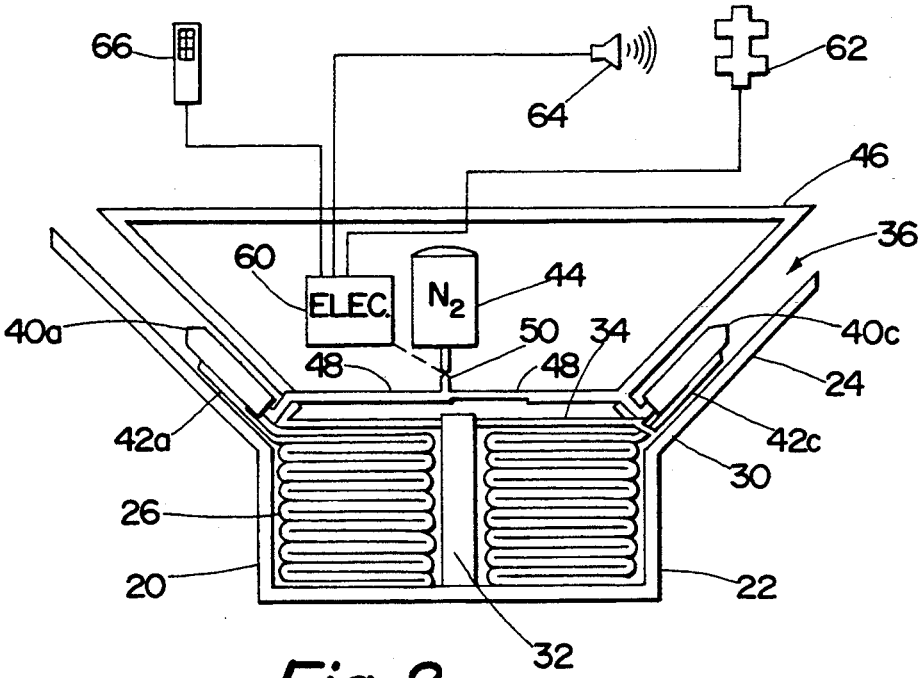
FIG. 2 is a sectional view of the invention mounted inside a building structure and schematically illustrating still other components of the invention.

A central support 30 has an axially extending post 32 about which the blanket is stored in its folded configuration (FIG. 2). An upper portion 34 of the central support advantageously separates the blanket from the remainder of the fire protection system, although still other arrangements can be used without departing from the scope and intent of the subject invention. The periphery of the upper portion of the central support defines a gap 36 (FIG. 2) that is circumferentially continuous and cooperates with means for deploying the blanket over the building structure. Specifically, the deploying means or assembly includes a set of circumferentially spaced projectile tubes 38*a*, 38*b*, and 38*c* disposed in the gap. For example, if four projectiles are to be used, the projectile tubes may be generally equally spaced apart by approximately 90°. Moreover, the projectile tubes are preferably disposed at an angle relative to horizontal. As shown, the projectile tubes in FIG. 2 are disposed at approximately 45° relative to the horizontal, although the tubes may be disposed at other angles. Moreover, the different tubes can adopt different angular orientations as may be dictated by the structural arrangement of the building and desired deployment of the fire protection system.

Each of the projectile tubes is dimensioned to receive a projectile 40*a*, 40*b*, and 40*c*, respectively. The projectiles are connected to the blanket 26 through connecting means such as connecting wires 42*a*, 42*b*, and 42*c*. It is contemplated that the wires will be secured adjacent the outer periphery of the blanket. Still other connecting structures can be used that would effectively secure the outer peripheral edge of the blanket to the projectile and provide for effective unfolding of the blanket during deployment.

Each of the projectiles is shown in FIG. 2 at a storage position located at the base of its respective tube. A source of compressed fluid such as a nitrogen gas tank 44 is located in an upper enclosure 46. The nitrogen tank is disposed in selective fluid communication with each of the projectiles through fluid lines 48. A valve 50 is provided in a common fluid line extending from the nitrogen tank to regulate the flow of nitrogen from the source through lines 48*a* through 48*c* through a router or distributor 52 (FIG. 1). The router is dimensioned to provide sufficient compressed fluid to each of the projectiles so that when the valve 50 is open, the projectiles will be advanced or projected outwardly through their respective tubes pulling the blanket from its folded, stored position upwardly and outwardly over the building structure.

Opening of the valve 50 is preferably controlled through an electronic interface and control unit 60. Associated with the control unit are an infrared sensor array 62, an alarm horn 64, and a remote monitoring and testing unit 66. The infrared sensor array 62 is used to detect a fire approaching the building structure and to send an appropriate signal to the control unit 60. Alternatively, a smoke detector or still other sensor arrangement can be used as the detection means for the automated fire protection system. The alarm horn provides an audible warning of the automatic deployment of the system. Also, if desired, the control unit may send an appropriate signal to a local fire department via the telephone lines or yet another communication arrangement. The overall system is preferably connected to the power supply for the building structure and will often include a battery backup unit 68 (FIG. 1) in case power is cut or terminated to the building structure.

One or more motors 70 is also electrically connected to the control unit so that a cover 72 (FIG. 1) may be moved by the motors from the remainder of the roof to provide an opening through which the blanket may pass from its storage location outwardly over the building structure. One skilled in the art will recognize that suitable gearing or other interconnection can be provided between the motors and the slide away roof cover 72 to quickly provide a passage opening for the projectiles as they carry the blanket toward a deployed position.

Figure 3:
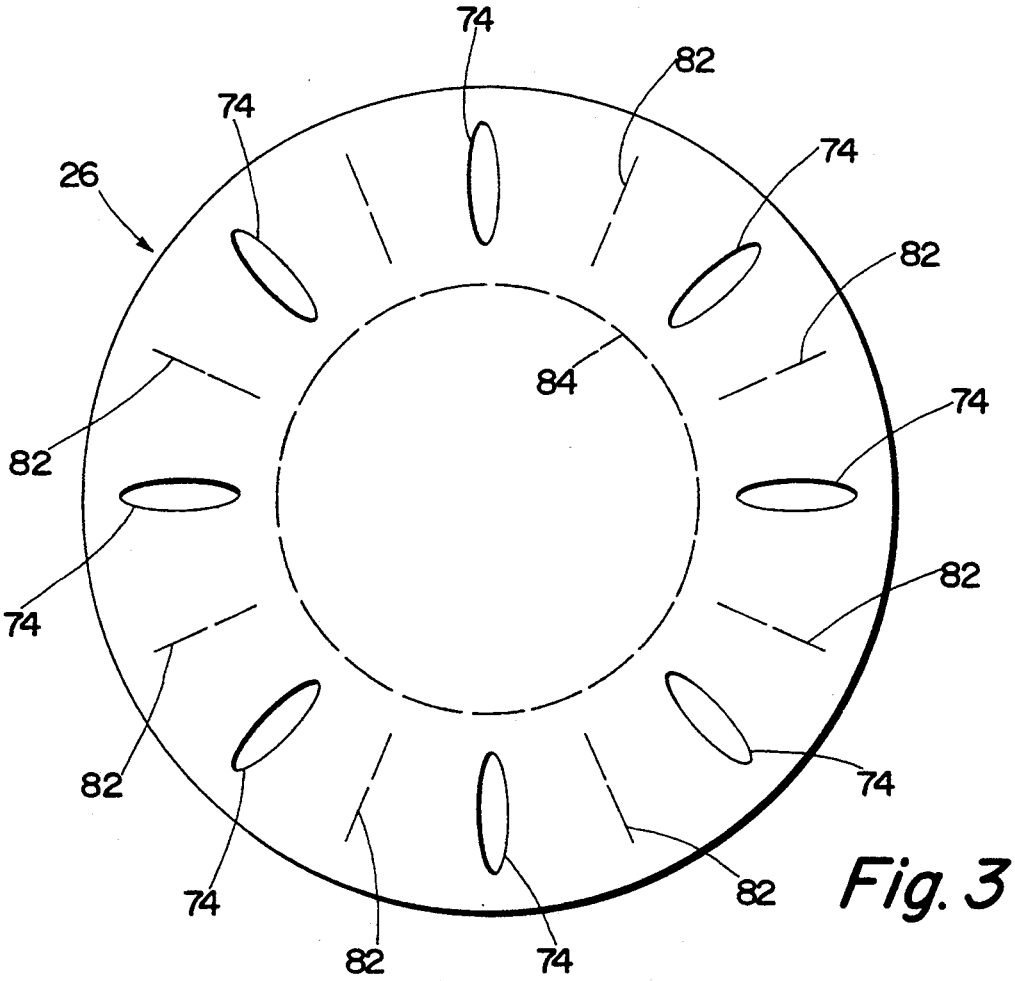
FIG. 3 is a top plan view of the fire resistant blanket.
Figure 4:
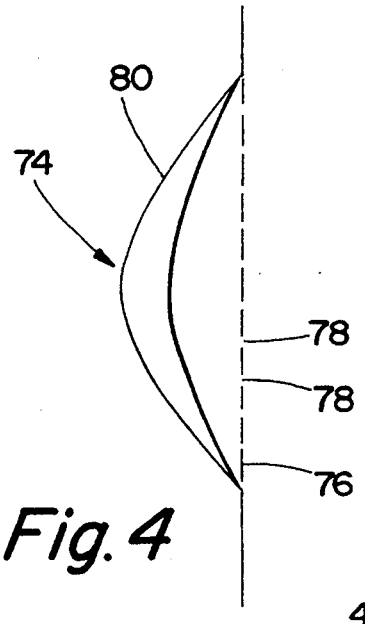
FIG. 4 is a side elevational view particularly illustrating the air bleed portion of the fire protection system.
Figure 5:
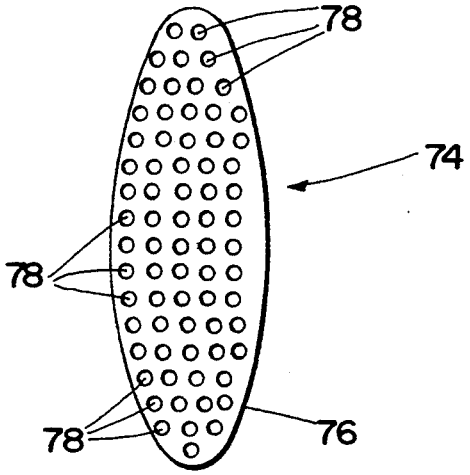
FIG. 5 is a plan view of the ventilated under section of the air bleed arrangement.

As particularly shown in FIG. 3, the blanket 26 is provided with air bleed portions 74. The air bleed portions are disposed in spaced relation in the blanket so that the blanket will quickly and easily collapse over the building structure during deployment. One of the air bleed portions is more particularly illustrated in FIGS. 4 and 5. It is comprised of a ventilated blanket under section 76 having openings 78 that communicate with the outside environment through a flap or lift-up blanket section 80 (FIG. 4). These air bleed portions allow any air trapped between the blanket 26 and the building structure B to pass outwardly through the blanket during deployment and settling of the blanket over the building structure. Still further, other openings may be provided to allow any trapped occupant to exit the blanket once it is deployed. For example, zippers or similar closures can provide ease of ingress and egress from the building structure.

FIGS. 6–9 illustrate the various stages of deployment of the fire protection system. As noted above, the blanket 26 is originally disposed or stored in the support 20 and hidden from view by the roof cover 72. Once an appropriate signal is provided by the sensor 62 or other detector means, the motors 70 open the roof cover. Once the roof cover is positioned out of the way, valve 50 is opened and pressurized fluid proceeds through fluid lines 48 and distributor 52 to the projectiles 40. As the compressed gas is forced into the projectile tubes 38, each of the projectiles is forced to accelerate upwardly and outwardly through their respective tubes. Since each of the projectiles is secured to the blanket through the connecting wire 42, the folded fire resistant blanket is carried upwardly and outwardly through the gap 36 for deployment over the building structure B.

Figure 6:
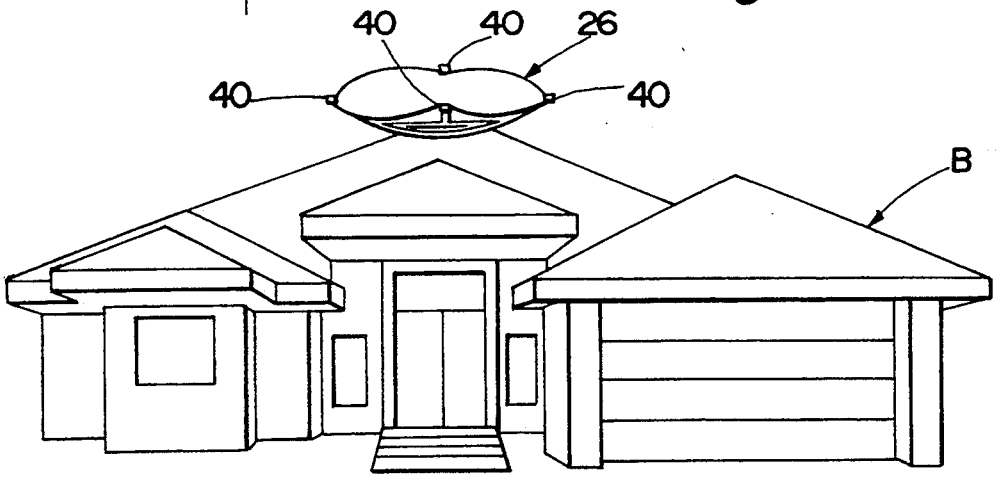
FIG. 6 is an elevational view of initial deployment of the fire protection system in accordance with the subject invention.
Figure 7:
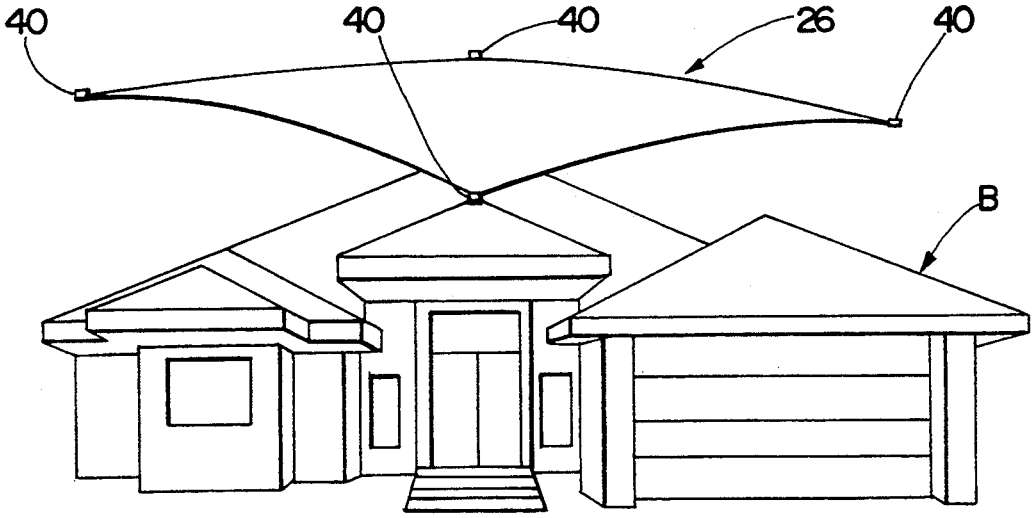
FIG. 7 illustrates a further stage in the deployment of the fire protection system.
Figure 8:
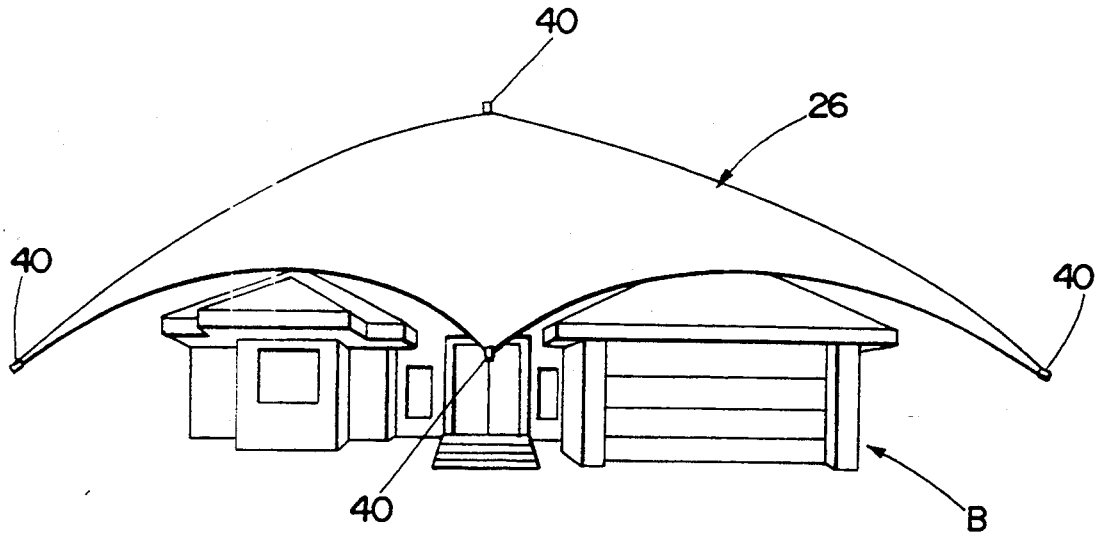
FIG. 8 illustrates a still further stage in the deployment of the fire protection system.
Figure 9:
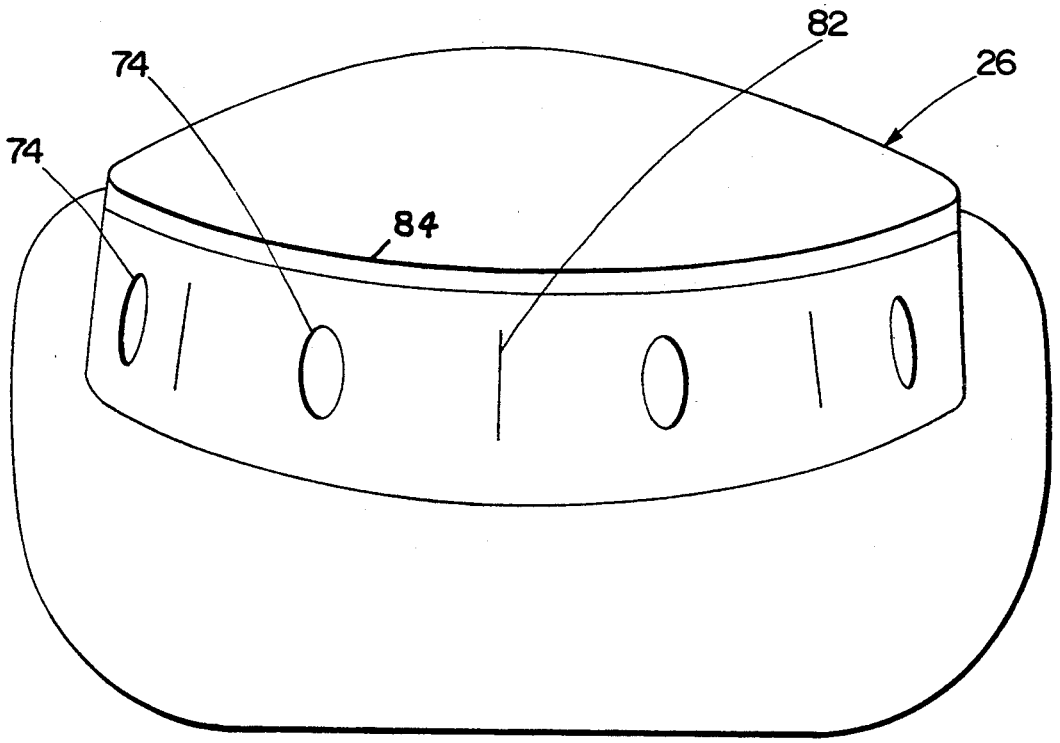
FIG. 9 is an elevational view of the fire protection system fully covering the building structure.

The forces applied to the projectiles, the angle of attack of the projectile tubes, and the weight and resistance of the fire resistant blanket are previously calculated to produce the desired deployment of the fire resistant blanket. Generally, the desired deployment trajectory is upwardly and outwardly over a full 360° to completely cover the building structure (FIGS. 6 and 7). The upward trajectory allows the blanket to cover any rooftop protrusions such as chimneys, antennas, or ventilation turbines. The kinetic energy delivered to the fire resistant blanket is sufficient to completely unfold and deploy the blanket in a few seconds. The stored energy from the fluid source is fully dissipated as the projectiles complete the trajectories. The blanket then quickly settles to the ground due to its own weight (FIG. 8), and covers the supporting walls of the building structure as it spreads out over the ground surrounding the building (FIG. 9).

Any air trapped between the blanket and the building structure can then pass outwardly through the air bleed portions 74. The weight of the blanket is sufficient to secure it to the housing, although an elastic strap 84 (FIGS. 3 and 9) may be provided in the blanket to more tightly secure the blanket to the building structure (FIG. 9). Zippers 82 provide ingress and egress through the deployed blanket and to the building structure if so required.

The kinetic energy delivered to the blanket is sufficient to deploy the blanket along the predetermined trajectory even in the presence of high winds. Moreover, the inclusion of one or more elastic straps 84 into the blanket and the weight of the blanket itself are sufficient to secure the blanket to the building structure even in the presence of high winds.

The automated exterior fire projection system provides a highly reliable, fully automated arrangement for exterior fire protection to a building structure. Accordingly, although the invention has been described with reference to the preferred embodiment, modifications and alterations will occur to others upon a reading and understanding of the specification. For example, a fire resistant blanket deployment system using an alternative to compressed gas may be used. Still other means for deploying the blanket in a rapid fashion could be used. Additionally, a different number of projectiles can be used if required for a particular building structure. The subject invention is intended to include all such modifications and alterations insofar as they come within the scope of the appended claims or the equivalents thereof.

Having thus described the invention, it is now claimed:

1. An automated fire protection system for a building structure, the system comprising:
   - a fire resistant blanket dimensioned for receipt over a building structure;
   - a deployment assembly for deploying the blanket over the building structure, the deployment assembly including plural projectiles connected to the blanket adapted to deploy the blanket over the building structure; and
   - a control unit that actuates the deployment assembly.

2. The system as defined in claim 1 further comprising a support structure adapted to be received in the building structure for storing the blanket.

3. The system as defined in claim 2 further comprising a cover overlying the blanket that is moved in response to detection of an approaching fire.

4. The system as defined in claim 3 further comprising at least one motor associated with the cover for movement thereof.

5. The system as defined in claim 2 further comprising an alarm connected to the control unit for providing indication of potential deployment of the blanket.

6. The system as defined in claim 1 further comprising a battery for supplying power to the control unit.

7. The system as defined in claim 1 wherein the deployment assembly further includes a fluid source operatively associated with the projectiles for propelling the projectiles over the building structure.

8. The system as defined in claim 1 wherein the blanket includes at least one air bleed portion that allows air between the blanket and building structure to pass outwardly during deployment of the blanket.

9. The system as defined in claim 1 wherein the blanket includes at least one opening that may be selectively opened to allow ingress and egress through the blanket to the building structure.

10. The system as defined in claim 1 wherein the control unit includes an infrared sensor for detecting an approaching fire.

11. The system as defined in claim 1 wherein the control unit includes a smoke detector for detecting an approaching fire.

12. The system as defined in claim 1 wherein plural projectiles are connected to the blanket for deploying the blanket over the building structure in response to a signal from the control unit.

13. An automated fire protection system for a building structure, the system comprising:
   - a fire resistant blanket dimensioned for receipt over a building structure;

a deployment assembly including a fluid source for deploying the blanket over the building structure; and a control unit that actuates the deployment assembly.

14. The system as defined in claim 13 wherein the deployment assembly includes plural projectiles connected to the blanket over the building structure.

15. The system as defined in claim 13 wherein the blanket includes at least one air bleed portion that allows air between the blanket and building structure to pass outwardly during deployment of the blanket.

16. The system as defined in claim 13 wherein the deployment assembly includes plural projectiles connected to the blanket for deploying the blanket over the building structure in response to a signal from the control unit.

17. The system as defined in claim 13 wherein the control unit includes a detector for sensing an approaching fire.

18. An automated fire protection system for a building structure, the system comprising:

a fire resistant blanket dimensioned for receipt over a building structure;

a deployment assembly for deploying the blanket over the building structure, the deployment assembly including plural projectiles connected to the blanket for deploying the blanket over the building structure; and a control unit for detecting an approaching fire and actuating the deployment assembly in response thereto.

19. An automated fire protection system for a building structure, the system comprising:

a fire resistant blanket dimensioned for receipt over a building structure, the blanket including at least one air bleed portion that allows air between the blanket and building structure to pass outwardly during deployment of the blanket;

a deployment assembly for deploying the blanket over the building structure; and a control unit that actuates the deployment assembly.

20. The system as defined in claim 19 wherein the control unit includes a detector for sensing an approaching fire.

* * * * *